US006033254A

United States Patent [19]

Neal et al.

[11] Patent Number: 6,033,254

[45] Date of Patent: Mar. 7, 2000

[54] LOCATING AND GUIDANCE DEVICE FOR PRINTED CIRCUIT BOARDS

[75] Inventors: Danny Marvin Neal, Round Rock; Roy Albert Rachui, Georgetown; James Robert Taylor, Leander; Fred Ervin Zumwalt, Austin, all of Tex.

[73] Assignee: International Business Machines Corporation, Armonk, N.Y.

[21] Appl. No.: 08/859,448

[22] Filed: May 20, 1997

[51] Int. Cl.[7] ..... H01R 13/64

[52] U.S. Cl. ..... 439/377; 439/342

[58] Field of Search ..... 439/377, 342, 439/64

[56] References Cited

U.S. PATENT DOCUMENTS

| | | | |
|---|---|---|---|
| 3,869,185 | 3/1975 | Teagno | 439/377 |
| 4,797,786 | 1/1989 | Belanger, Jr. | 439/377 |
| 5,317,483 | 5/1994 | Swindler | 361/801 |
| 5,337,213 | 8/1994 | Agur | 361/684 |
| 5,338,214 | 8/1994 | Steffes et al. | 439/160 |
| 5,339,222 | 8/1994 | Simmons et al. | 361/818 |
| 5,440,448 | 8/1995 | Stewart et al. | 361/684 |
| 5,473,505 | 12/1995 | Kessoku et al. | 361/684 |
| 5,492,480 | 2/1996 | Fusselman et al. | 439/157 |
| 5,492,481 | 2/1996 | Lewis | 439/159 |
| 5,519,577 | 5/1996 | Dudas et al. | 361/737 |
| 5,531,328 | 7/1996 | Rochelo et al. | 206/706 |
| 5,537,292 | 7/1996 | Bowen | 361/737 |
| 5,544,006 | 8/1996 | Radloff et al. | 361/683 |
| 5,548,484 | 8/1996 | Kantner | 361/737 |
| 5,657,204 | 8/1997 | Hunt | 439/377 |
| 5,868,585 | 2/1999 | Barthel et al. | 439/377 |

*Primary Examiner*—Steven L. Stephan
*Assistant Examiner*—T. C. Patel
*Attorney, Agent, or Firm*—Mark E. McBurney; Robert V. Wilder

[57] ABSTRACT

A circuit board guidance device is arranged to have a circuit board such as a PCI I/O board 205 inserted therein for connection into an electrical socket or connector 203 located on a system motherboard 201. The guidance device includes a guidance mechanism which translates an insertion force applied in one direction into a connecting force effective to move the circuit board in a second direction. The guidance device is effective to aid in locating the circuit board 205 above connector 203 on the system motherboard 201, and also to aid in forcing the desired electrical connection between corresponding connectors on the circuit board 205 and a system motherboard 201. The guidance device is also effective in aiding in the extraction of the circuit board from its connection to the motherboard connector 203. An I/O bracket 261 is implemented to provide EMI grounding to the system bulkhead.

14 Claims, 2 Drawing Sheets

LOCATING AND GUIDANCE DEVICE FOR PRINTED CIRCUIT BOARDS

CROSS REFERENCE TO RELATED APPLICATIONS

"AUTODOCKING HARDWARE FOR ADAPTER CARDS", filed Nov. 2, 1995, docket number AT9-95-044, Ser. No. 08/552,186 now U.S. Pat. No. 5,644,470, and assigned to the assignee of the present application.

FIELD OF THE INVENTION

The present invention relates generally to printed circuit boards and enclosures therefor, and more particularly to an improved circuit board insertion and extraction apparatus for use in installing and removing circuit boards, such as standard PCI I/O adaptor add-in boards, from system enclosures.

BACKGROUND OF THE INVENTION

In computer systems, workstations and other electronics-intensive products and systems, ICs (integrated circuits) including processors, memory systems, controllers, logic circuits together with other system components and ASICs (application specific integrated circuits) are generally mounted on circuit boards within a system enclosure. The circuit boards are, in turn, generally coupled to connector terminals on a main system board or motherboard. The motherboard is typically positioned adjacent to, and mechanically supported by, one of the two major walls or panels of an enclosure because the motherboard is typically the largest board in the enclosure, and also in order to provide a stable support base for smaller circuit boards or so-called daughter boards, which may be inserted into connectors mounted on the motherboards.

Heretofore, when a circuit board was being installed into an enclosure, the main panel or wall of the enclosure needed to be removed in order to provide access to the connector on the motherboard and also to give an installer the leverage required to apply an in-line force to make certain a solid electrical connection is established and the daughterboard is securely connected. Even as systems are upgraded, and/or new functions or additional functions are implemented on new boards which need to be installed in existing systems and enclosures, or when boards need to be removed for troubleshooting or maintenance, a main panel or side of the electronics system enclosure needs to be fully removed.

In most system environments, space is critical. In systems or network environments or host-terminal systems, servers or computer enclosures are usually mounted in close quarters or even in cabinets or equipment racks where access is extremely limited. In such environments, board replacement or installation is a major task since the enclosure needs to be brought out to an open area and one of the main panels has to be removed in order to have access to the motherboard and connectors within the electronics enclosure. In some cases, the server unit may be mounted on a slidable tray support and the server may be slidably removed from its normal operating position, but even in that case, a major panel of the enclosure must be removed to gain access to the enclosed circuit boards. Moreover, certain EMI requirements must be considered and met in connection with any new design for electronics enclosures.

It is desirable, therefore, to provide a board-mounting method and apparatus in which boards may be more easily installed and removed from motherboards and/or other mountings within system enclosures without the need to remove one of the major panels from the enclosure, but still providing sufficient leverage to positively seat and unseat circuit boards mounted into system connectors on the motherboard or other locations within system enclosures. It is further desirable to provide a board mounting method and apparatus as set forth which complies with EMI requirements. Accordingly, there is a need for an improved method and apparatus which is effective to enable inserting and extracting circuit boards from electronic system component enclosures and board connectors therein. There is a further need to provide the improved method and apparatus as stated, and further including means effective to modify EMI radiation to be compliant with applicable standards.

SUMMARY OF THE INVENTION

A guidance device includes a base member, an actuating member, a slide member and a card attachment member. The base member is arranged within an enclosure to provide support and a reference for use in the process of inserting and/or removing a daughterboard from an electrical socket or connector on a motherboard within the enclosure. The base member is aligned within the enclosure to effectively ensure the proper alignment between a circuit board being inserted or removed, with an electrical connector located on a system motherboard. The guidance device attaches to a daughterboard to be mounted in a motherboard connector. The guidance device is effective to translate an insertion force applied in a first direction upon a daughterboard, into a connecting force exerted upon the daughterboard in a second direction as the daughterboard is inserted into an enclosure. After the daughterboard is electrically connected and seated to an electrical connector on the motherboard, the device is detachable from the daughterboard and may be removed from the enclosure. In a similar fashion, the guidance device may be utilized in removing a daughterboard by asserting a disconnecting force on a daughterboard as the board is pulled out from an enclosure thereby aiding in the disconnection of the daughterboard from a motherboard connector. In a preferred embodiment, the guidance device includes an I/O bracket coupled to the device to provide improved EMI shielding.

BRIEF DESCRIPTION OF THE DRAWINGS

A better understanding of the present invention can be obtained when the following detailed description of a preferred embodiment is considered in conjunction with the following drawings, in which.

DETAILED DESCRIPTION

Figure 1:
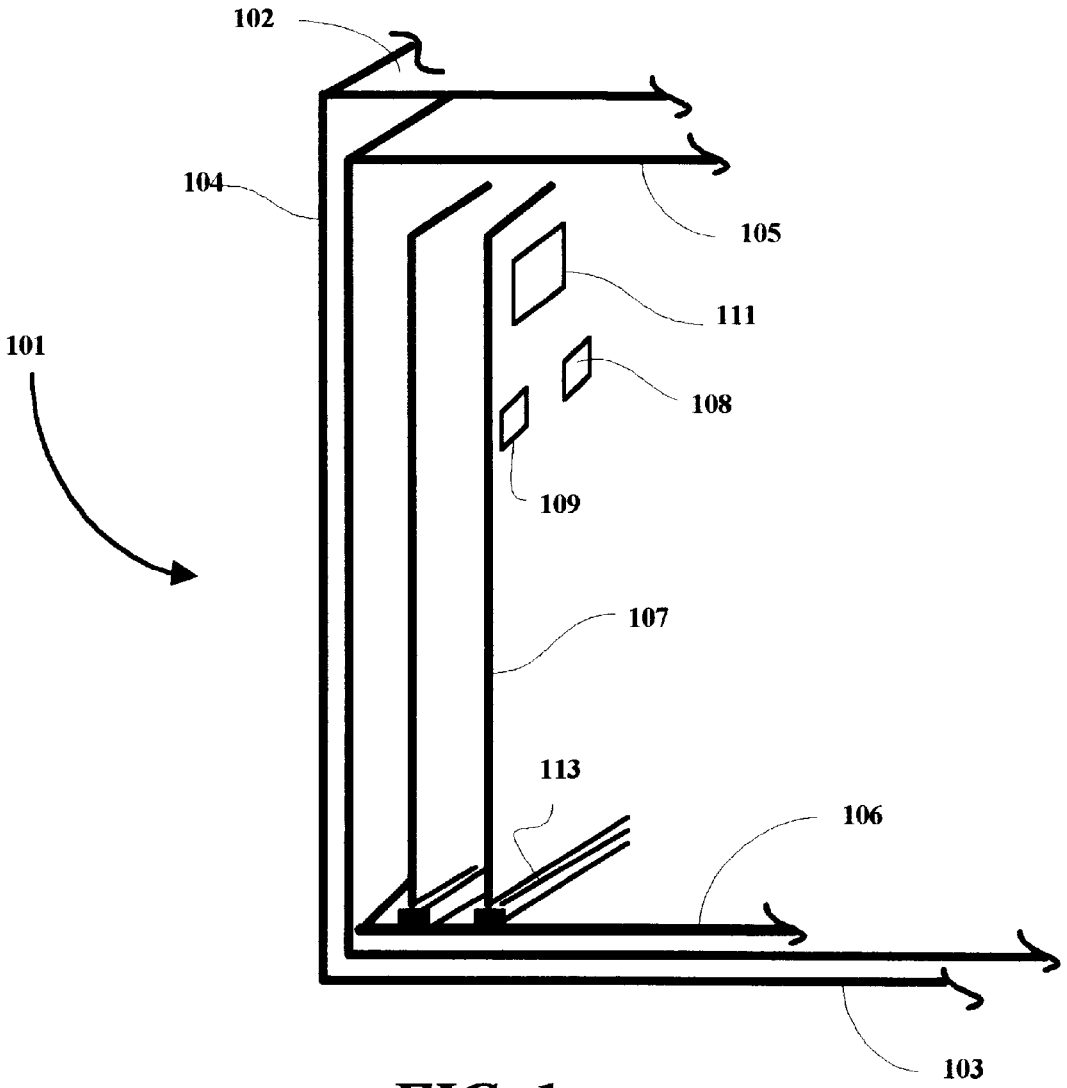
FIG. 1 is a simplified schematic illustration of an electronics enclosure including a motherboard with daughterboards mounted thereon.

With reference to FIG. 1, there is shown an enclosure 101 for housing components of an electronic system, for example, a computer system. The enclosure 101 includes two major panels, i.e. a top panel or surface 102 and a bottom panel or surface 103. The enclosure also includes four smaller side panels including side panel or surface 104.

The illustration also shows a frame 105 within the enclosure 101, and a base circuit board or so-called "motherboard" 106, which is arranged to have "daughterboards" such as standard PCI I/O add-in boards, for example board 107, mounted into connectors 113 located on the motherboard 106. Typically, the daughterboards such as board 107 have integrated circuits or ICs, such as IC 108, IC 109 and IC 111 mounted thereon. The integrated circuits may include memory devices, controller circuits, custom chips, ASICs and the like. The individual integrated circuits and other components mounted on daughter boards are electrically connected to a board connector on the daughterboard 107 (in the case of PCI, through a PCI interface chip) and that connector is mechanically and electrically fitted into a corresponding connector 113 on the motherboard 106 within the enclosure 101.

Typically, when a daughterboard needs to be pulled from an enclosure for replacement or upgrading, the main cover 102 of the system enclosure 101 must be removed to gain access to the daughterboards. To remove a daughterboard 107, the daughterboard (e.g. daughterboard 107), must then be pulled in an upward direction to free the daughterboard electrical connector from its corresponding connector 113 on the motherboard 106. In order to insure a solid electrical connection between the motherboard 106 and daughterboard 107, the fit of the daughterboard connector and the motherboard connector is relatively tight and requires a significant amount of force to insert or extract the daughterboard from its connection on the motherboard. Because of the need to exert relatively strong upward and downward forces to dislodge or disengage a daughterboard or to install a new board, it is typically necessary to remove a portion of, or the entire top panel 102 from the electronics enclosure 101 to provide room to gain mechanical leverage in installing or removing daughterboards.

Figure 2:
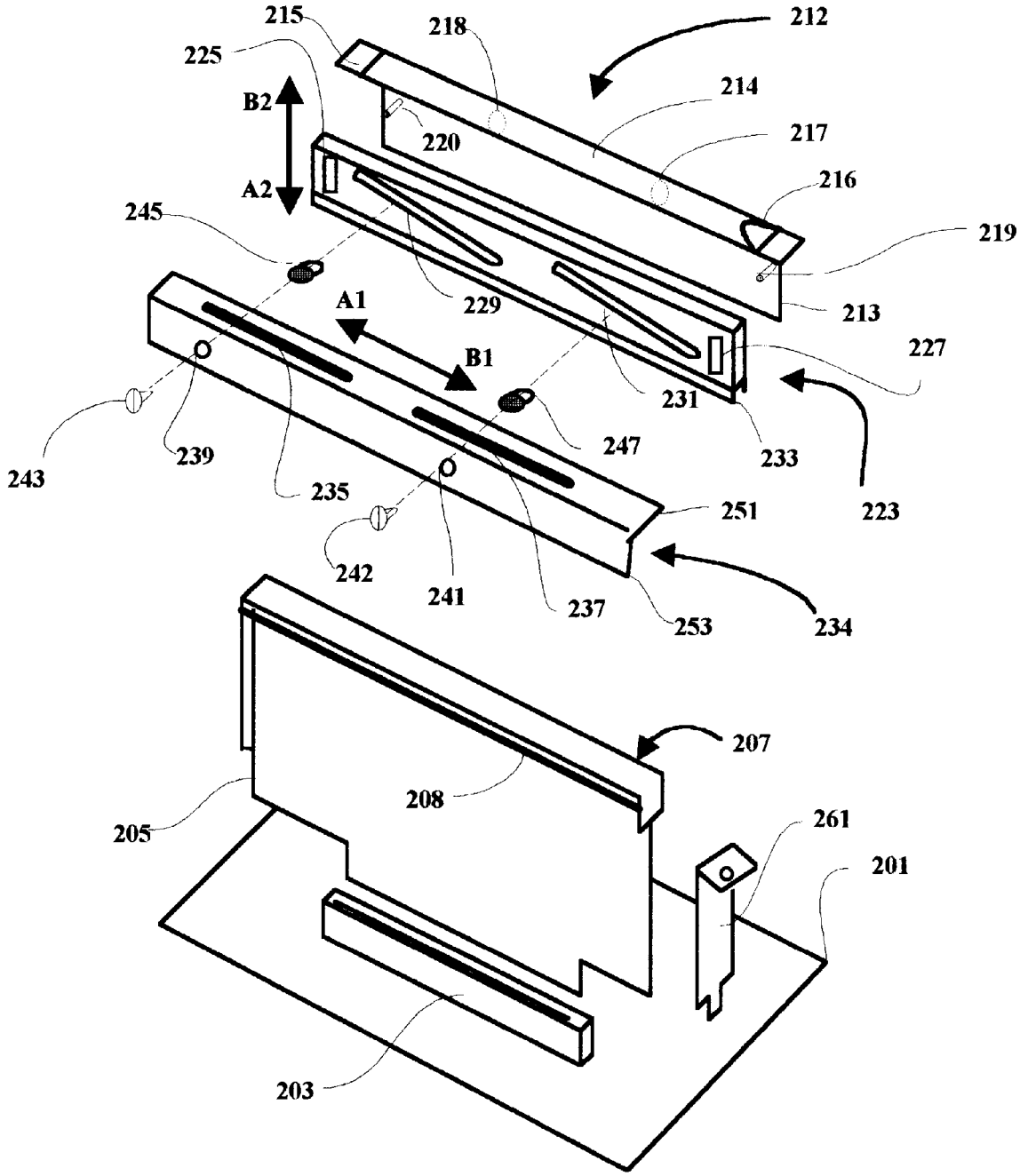
FIG. 2 is an exploded perspective view of a guidance device implemented in accordance with the present invention.

In FIG. 2, there is shown a daughterboard locating and guidance device which is useful in locating, i.e. properly aligning, and also inserting or removing, daughterboards from their proper connectors on motherboards in electronics systems. The illustrated apparatus permits access to daughterboards from side panels of enclosures to insert and remove daughterboards from system enclosures without the need for removing a major enclosure panel or without the need for transporting the entire enclosure from its mounted or operating location to a shop for disassembly. The guidance device illustrated includes a base member 212, an actuating member 223, a slide member 234 and a card frame member 207. As shown in FIG. 2, a motherboard 201 includes a daughterboard connector device 203 which is arranged to receive, and electrically connect with a matching connector from a daughterboard 205. A card frame member 207 is removably clipped on to the daughterboard 205. The frame may be designed in one of several ways, to provide a "clipping-on" function such that the frame may be selectively "snapped-on" or "snapped-off" from a standard card or daughterboard 205 in a manner to allow use of standard I/O boards such as PCI I/O boards. The card frame member 207 further includes a groove 208 which runs along each side of the card frame 207 near the top of the frame. The grooves 208 are positioned parallel to the top of the card frame 207. The grooves 208 are arranged to be selectively coupled to a corresponding gripping device 233 located along the bottom of an actuating member 223 as is hereinafter explained. Other coupling devices may also be used to accomplish the slidable attaching or coupling function between the card frame 207 and the actuating member 223.

The guidance device illustrated in FIG. 2 also includes a base member 212 having a side wall 213 and a top surface 214. The top surface 214 further includes a locking tab 215 and a locking clip 216 formed thereon for selective engagement with corresponding locking devices on the frame 105 within enclosure 101 as shown in detail in FIG. 3. The base member 212 has vertical alignment pins 219 and 220 which are arranged to engage with corresponding vertical alignment slots 227 and 225 of an actuating member 223. The base member 212 also includes first and second horizontal guide pins or bosses 217 and 218 which are arranged to engage with corresponding engagement slots 237 and 235, respectively, of a slide member 234 of the guidance device. The actuating member 223 includes first and second follower guide slots 229 and 231 which are downwardly sloping slots relative to the main horizontal axis of the actuating member 223.

The slide member 234 of the guidance device includes first and second guide followers 245 and 247 which are secured to the slide member 234 by means of screws or the like 242 and 243 connected through alignment holes 241 and 239 thereby connecting the guide followers 245 and 247 to the slide member 234. Guide slots 229 and 231 and guide followers 245 and 247 provide proper alignment of the daughterboard electrical connector to properly insert the daughterboard connector into the corresponding motherboard connector in a direction perpendicular to the motherboard thereby avoiding skewing of the card relative to the connector. As illustrated, the edge 251 of the slide member 234 will slide near the side wall 213 of the base member 212 above the pins 219 and 220 as the slide member is moved along its longitudinal axis in inserting and extracting a daughterboard 205 as hereinafter explained.

An ISA I/O bracket 261 is arranged to have the card side of the bracket 261 connected to the daughterboard 205 in a normal manner by means of rivets or screws or the like fastened through tabs (not shown) located on the bracket 261 to the non-conductive substrate body of the daughterboard 205. The bracket 261 is arranged to be grounded to the system bulkhead on the outside of the enclosure to provide improved EMI shielding when the daughterboard has been inserted into its connector within the enclosure. As the daughterboard is moved into its connected position, the I/O bracket 261 is arranged to slide along the outside of the enclosure opening provided to receive the daughterboard. In systems designed for autodocking of PCI cards, the bulkhead or enclosure openings (not shown) are also redesigned to allow insertion of the PCI cards through bulkhead openings without having to open the system covers. Also, the bulkhead opening is designed to allow the bulkhead around the opening to provide EMI shield grounding between the standard ISA bracket and the bulkhead. The disclosed approach to EMI shielding allows EMI grounding to be grounded to an outside surface of the bulkhead instead of to an inside surface as is currently done. The bulkhead at the opening for card insertion may be fabricated as more than one part.

Figure 3:
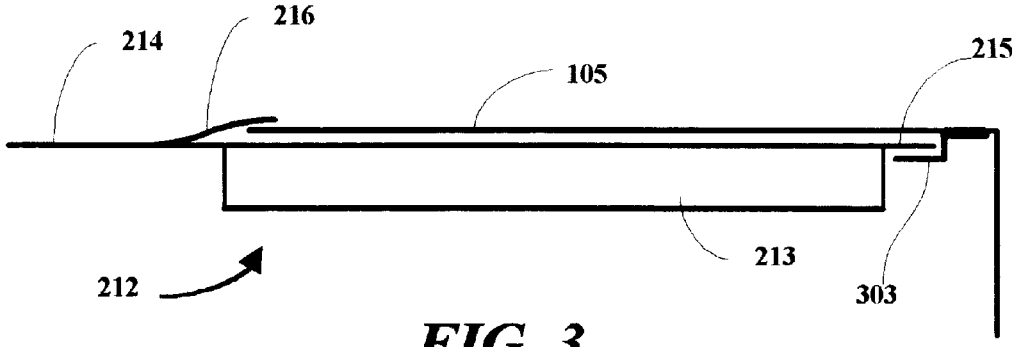
FIG. 3 is illustration of a simple enclosure attachment device which may be used in conjunction with a preferred embodiment of the present invention.

In FIG. 3, a detailed illustration shows the base member 212 engaged with or locked into the frame structure 105. The locking tab 215 of the base member 212 is engaged with a holding bar 303 which is shown attached to the frame structure 105. In a similar manner, the locking clip 216 of the base member 212 is slipped over the top of the frame structure 105 thereby locking the base member 212 into a fixed position relative to the frame structure 105. The holding bar 303 is mounted on the frame structure 105 directly above a connector device 113 on a motherboard 106 in order to ensure that a daughterboard will be properly aligned with the connector when the daughterboard is inserted using the guidance device illustrated in FIG. 2. The holding bar 303 and frame structure 105 comprise a support means for supporting the guidance device relative to the motherboard connector 203 and the enclosure.

In operation, the base member 212 is arranged to provide support and guidance in the process of inserting and/or removing a daughterboard 205 from an electrical socket or connector 203 on a motherboard 201. The guidance device applies a downward force upon a daughterboard 205 being inserted into a motherboard connector 203 as a card 205 is pushed into an enclosure 101. Similarly, the guidance device asserts an upward pressure on a daughterboard 205 as the board is pulled out from an enclosure thereby aiding in the disconnection of the daughterboard 205 from the motherboard 201.

The base member 212 provide a positional reference between the motherboard 201, the connector 203 and the various components of the board insertion device including the actuator member 223 and the slide device or follower slide 234. The follower slide member 234 is arranged to slide above the top surface of the actuator member 223. As the slide member 234 moves above the top surface of the actuator member 223, the followers 245 and 247 engage with the slots 229 and 231 thereby forcing the actuator member downwardly. Since the actuator member 223 is clipped on to the card frame 207 and therefore the daughterboard 205, by means of the clipping device 233 of the actuating member 223 and grove 208 of the card frame 207, the daughterboard 205 is forced downwardly as the follower slide member 234 is pushed inwardly. That movement relationship is illustrated in FIG. 2 where movement of the slide member 234 in a direction Al causes a corresponding movement in the actuating member 223 and connected daughterboard 205 in a direction A2 for insertion of the daughterboard 205 into the connector 203. Similarly, movement of the slide member 234 in a direction B1 causes a corresponding movement in the actuating member 223 and connected daughterboard 205 in direction B2 thereby aiding in disconnecting the daughterboard 205 from the connector 203. The pins 219 and 220 of the base member 212 allow movement of the actuator 223 in a vertical direction but not in the horizontal direction.

The guidance device illustrated is designed such that the base member 212, the actuating member 223 and the slide member 234 comprise a tool device which may be used in conjunction with a clipped-on card frame to insert or extract a daughterboard, and then the tool may be detached from the daughterboard and removed when the board has been connected to or extracted from a motherboard connector. Holding bars such as holding bar 303 may be easily installed on the frame structures of new and existing enclosures to allow use of the guidance tool, and card frames are designed to clip on to existing standard circuit cards. Therefore, the guidance device disclosed herein may be used with existing enclosures to provide a significant advantage in the alignment, insertion and extraction of daughterboards into corresponding connectors on system motherboards.

The method and apparatus of the present invention has been described in connection with a preferred embodiment as disclosed herein. Although an embodiment of the present invention has been shown and described in detail herein, along with certain variants thereof, many other varied embodiments that incorporate the teachings of the invention may be easily constructed by those skilled in the art. Accordingly, the present invention is not intended to be limited to the specific form set forth herein, but on the contrary, it is intended to cover such alternatives, modifications, and equivalents, as can be reasonably included within the spirit and scope of the invention.

What is claimed is:

1. A guidance device for use in inserting a circuit board into an enclosure for coupling the circuit board to a connector located within the enclosure, said guidance device comprising:

an actuating device including circuit board coupling means for selectively coupling said guidance device to said circuit board whereby said guidance device together with said circuit board are selectively insertable into said enclosure as a single unit, said guidance device being further operable for inserting an electrical connector on said circuit board into an electrical connector within said enclosure;

a base member removeably engageable with corresponding support means on said enclosure to provide a base reference position relative to said electrical connector within said enclosure; and a movable member coupled between said base member and said actuating means, said movable member being selectively moveable by a user whereby movement of said movable member by a user in a first direction causes movement of said actuating device in a second direction, said movement of said actuating device in said second direction being effective to cause said inserting of said electrical connector on said circuit board into said electrical connector within said enclosure, said board coupling means being operable to de-couple said guidance device from said circuit board whereby said guidance device is selectively removable from said enclosure separately from said circuit board.

2. The guidance device as set forth in claim 1 wherein said electrical connector within said enclosure is a multi-pin electrical connector.

3. The guidance device as set forth in claim 1 wherein said electrical connector within said enclosure is located on a system motherboard within the enclosure.

4. The guidance device as set forth in claim 1 wherein said guidance device is further selectively operable to translate a pulling force applied to the moveable member in said first direction to an extraction force applied to the electrical connector on said circuit board in said second direction, to aid in disconnecting said electrical connector on said circuit board from said electrical connector in said enclosure.

5. The guidance device as set forth in claim 4 wherein said electrical connector within said enclosure is a multi-pin electrical connector.

6. The guidance device as set forth in claim 5 wherein said electrical connector within said enclosure is located on a system motherboard within the enclosure.

7. The guidance device as set forth in claim 4 wherein said electrical connector within said enclosure is located on a system motherboard within the enclosure.

8. The guidance device as set forth in claim 1 wherein said guidance device further includes alignment means coupling said base member and said actuating device, said alignment means being arranged for maintaining alignment between said base member and said actuating device as said actuating device moves in said second direction.

9. The guidance device as set forth in claim 8 wherein said actuating device comprises a follower slot device, said moveable member further comprising a follower device, said follower device being arranged to engage with said follower slot device for altering said direction of movement of the circuit board.

10. The guidance device as set forth in claim 9 wherein said follower slot device comprises a slotted channel arranged in a downwardly sloping direction relative to said first direction.

11. The guidance device as set forth in claim 9 wherein said follower slot device comprises first and second slotted channels arranged in a downwardly sloping direction relative to said first direction, said follower device comprising first and second follower elements arranged for engagement with said first and second slotted channels.

12. The guidance device as set forth in claim 9 wherein said circuit board coupling means is designed to couple with a circuit board frame attached to said circuit board.

13. The guidance device as set forth in claim 1 and further including an EMI grounding device arranged to electrically couple the circuit board to a system ground, said EMI grounding device being arranged to slide along an outside surface of said enclosure.

14. The guidance device as set forth in claim 1 wherein said electrical connector within said enclosure is mounted on a system motherboard, and wherein said second direction is a direction perpendicular to said system motherboard.

* * * * *